United States Patent [19]

Leslie et al.

[11] Patent Number: 5,014,476

[45] Date of Patent: May 14, 1991

[54] MULTICOMPONENT PANEL SYSTEM AND METHOD AS ASSEMBLY

[75] Inventors: Robert H. Leslie, Edina; Glynn F. Neumann, Lakeville; Gene A. Pehrson, St. Paul, all of Minn.

[73] Assignee: Bellcomb Technologies Incorporated, Minneapolis, Minn.

[21] Appl. No.: 334,925

[22] Filed: Apr. 7, 1989

[51] Int. Cl.[5] ..... E04B 2/32

[52] U.S. Cl. ..... 52/220; 52/293; 52/284; 52/586

[58] Field of Search ..... 52/220, 586, 293, 284, 52/285, 799, 404

[56] References Cited

U.S. PATENT DOCUMENTS

| | | | |
|---|---|---|---|
| 1,067,792 | 7/1913 | Baron . | |
| 2,065,433 | 12/1936 | Dercum | 52/799 |
| 2,129,441 | 9/1938 | Otto . | |
| 2,134,637 | 10/1938 | Loucks | 52/293 |
| 2,218,465 | 10/1940 | Gunnison . | |
| 3,529,389 | 9/1970 | Wilkins . | |
| 3,543,462 | 12/1970 | Spratt et al. . | |
| 3,641,720 | 2/1972 | Berrie . | |
| 4,114,333 | 9/1978 | Jones et al. . | |
| 4,373,313 | 2/1983 | Nash | 52/799 |
| 4,596,100 | 6/1986 | Grocott . | |
| 4,621,467 | 11/1986 | Golden . | |
| 4,625,476 | 12/1986 | Shimada . | |
| 4,720,948 | 1/1988 | Henley | 52/404 |

*Primary Examiner*—John E. Murtagh

*Attorney, Agent, or Firm*—James R. Haller

[57] ABSTRACT

A multicomponent panel system including prefabricated, components machined to tight tolerances which can be assembled at a job site in a tight-fitting relationship.

2 Claims, 4 Drawing Sheets

Fig. 1 PRIOR ART
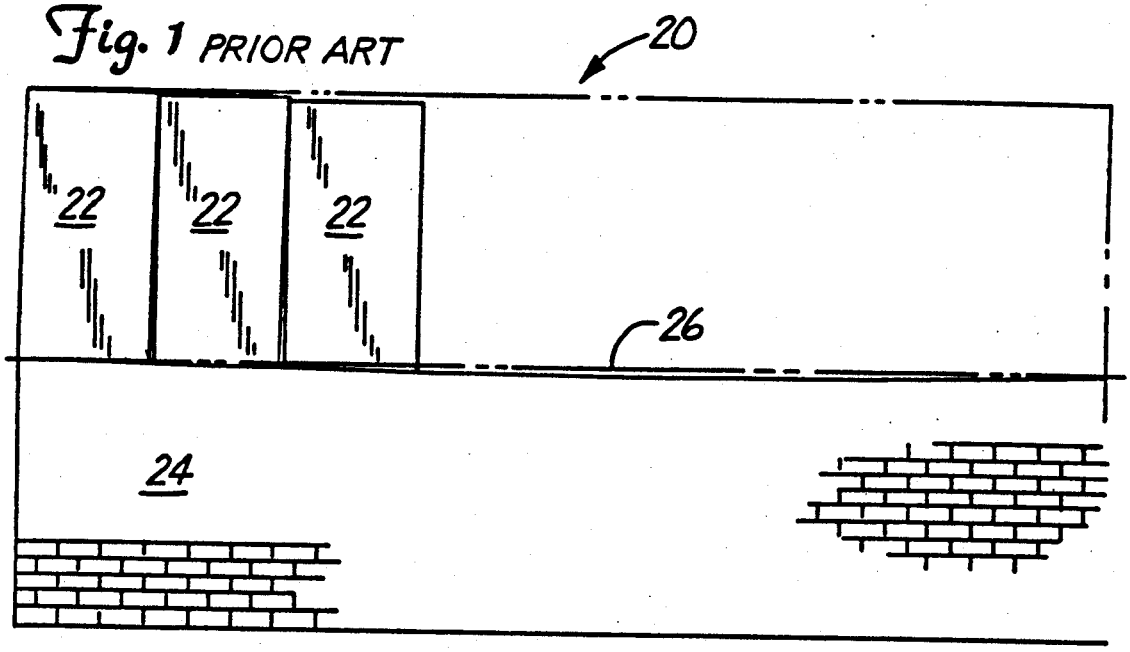
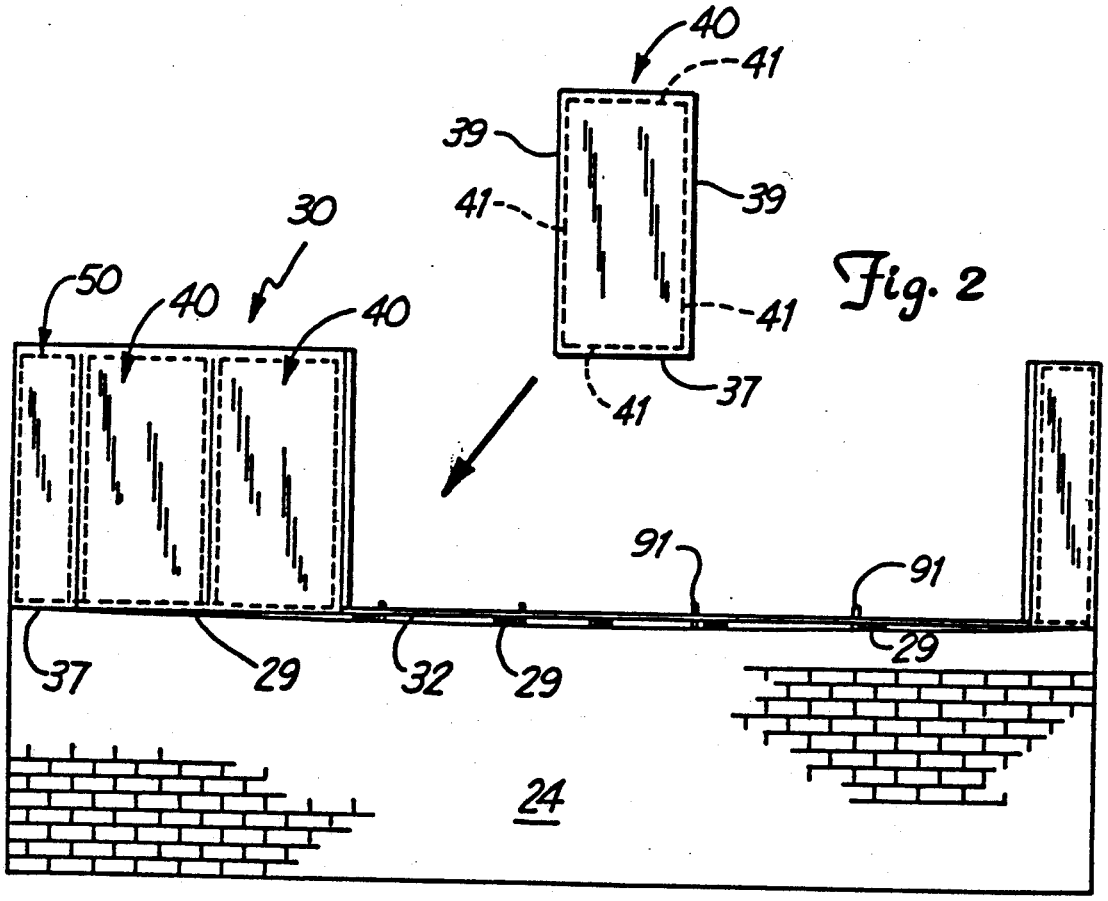
Fig. 2

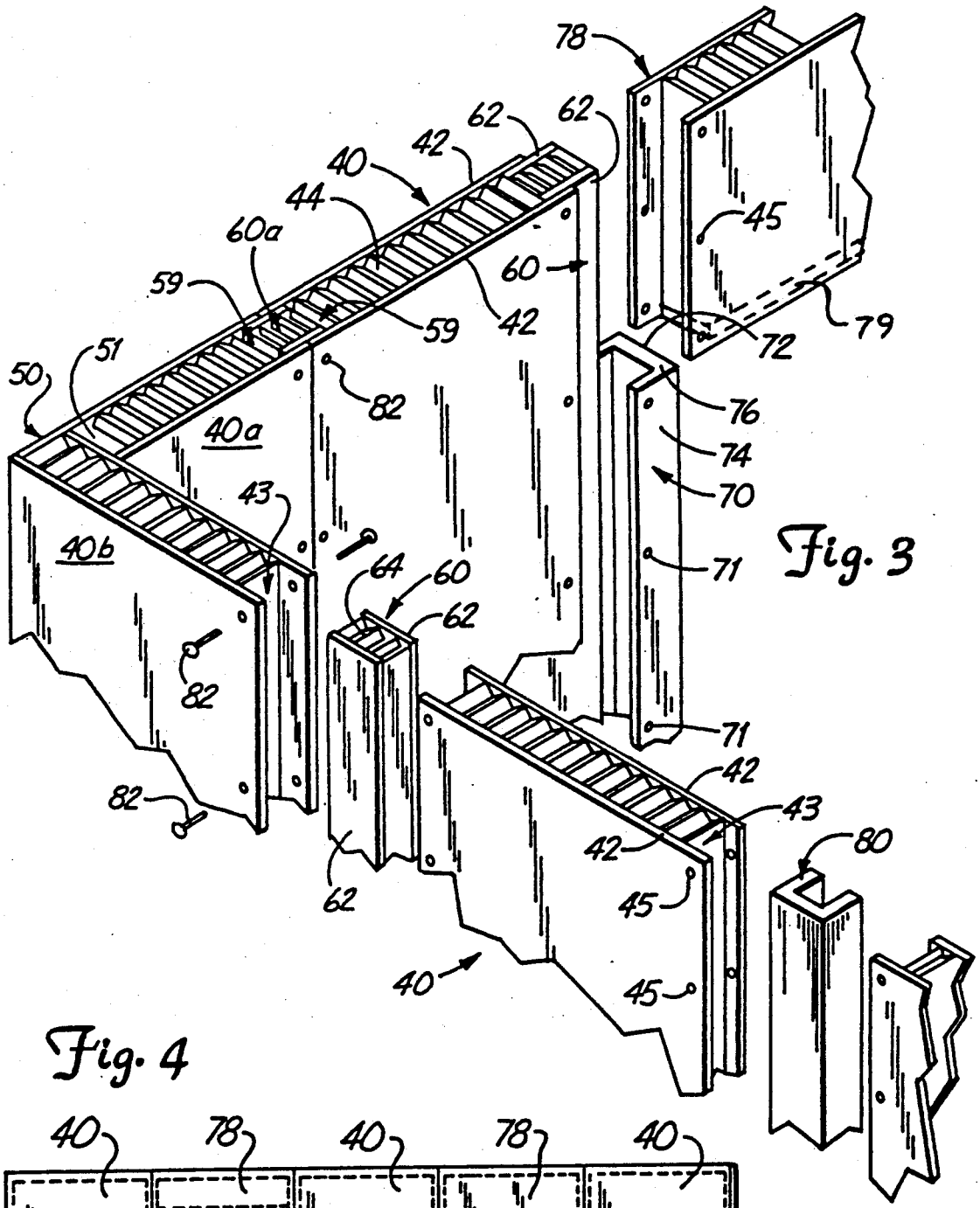
Fig. 3
Fig. 4
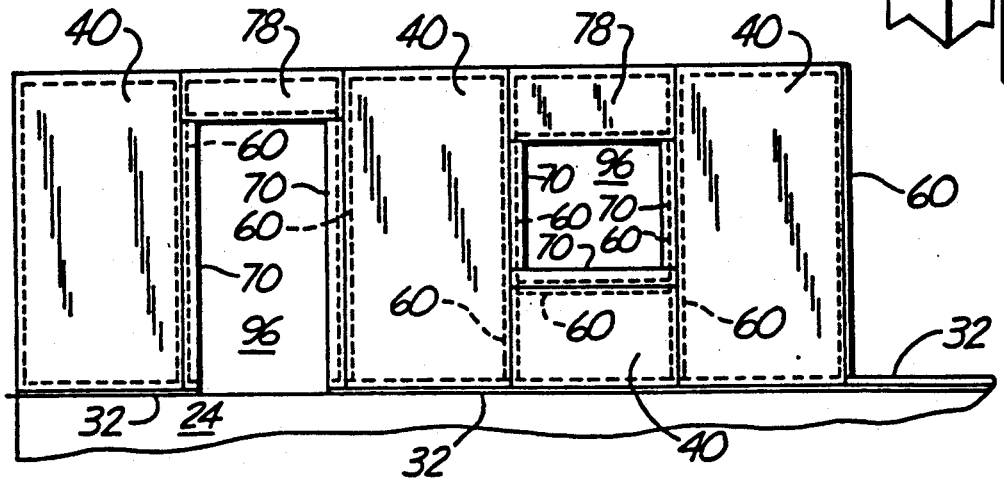

MULTICOMPONENT PANEL SYSTEM AND METHOD AS ASSEMBLY

TECHNICAL FIELD OF THE INVENTION

The present invention relates to a prefabricated multicomponent panel system.

A typical problem associated with existing prefabricated panel systems is that when assembled at the building site they are not sufficiently flexible to allow easy adaptation to various architectural plans. Typically, panels are precut into pre-existing dimensions such as 4×8, 6×10, etc. If the architectural plans call for any deviation from this, it is very difficult to adapt the panels to the building specification. Furthermore, there is a problem associated with creating windows and doorways from such prefabricated panel structures.

Still another problem associated with assembling prefabricated panels at the job site is that it is difficult to level and/or square the structures. For example, if the foundation is not level, the wall will be inclined as the panels are put together such that at the juncture of two intersecting walls there will be an improper fit. Additionally, panels which are roughly cut will not always be level or square. Additionally, the corners of the foundation are often times not perfectly square such that two walls which are meant to be at ninety degrees with respect to one another in fact extend out at something other than ninety degrees and create a problem when the next corner wall is assembled.

The present invention solves these and other problems.

SUMMARY OF THE INVENTION

The present invention relates to a multicomponent panel system wherein the interacting cooperating parts are closely machined (planed) so as to ensure a proper alignment and fit between the individual components of the system.

The present invention further relates to a method of assembling the multicomponent panel system such that partitions formed by the multicomponent system are square with one another and level.

The preferred embodiment of the present invention is machined (planed) to tolerances typically associated with metal tolerances as opposed to the large tolerances associated with wood. In a preferred embodiment, male parts (inserters) are machined to within minus three thousandths of an inch (−0.003), i.e., the desired size to the desired size −0.0003 inches, whereas female parts (receptors) are machined to within plus three thousandths of an inch (+0.003), i.e., the desired size to the desired size +0.0003 inches. Most dimensions are machined to be within ± three to five thousandths of an inch.

The present invention relates to a multicomponent panel system including a machined, one-piece, generally T-shaped plate having a stepped-up portion which is rectangular in cross-section and a base portion which is also rectangular in cross-section, of greater width than the stepped-up portion. The multicomponent system further includes a honeycomb panel having two spaced-apart, parallel sheets separated by a honeycomb structure intermediate thereof, the honeycomb structure defines a plurality of openings extending perpendicular to the sheets, the sheets of the honeycomb panel being machined along edge portions of the panel to enable insertion of the stepped-up portion of the plate intermediate of the sheets in a tight-fitting relationship. A machined panel corner structure comprising two honeycomb panels secured to one another so as to form a ninety degree angle is yet another component of the multicomponent panel system. A further component is a spline being rectangular in cross-section and comprising two spaced-apart, parallel sheets separated by a honeycomb structure, the spline is machined to enable insertion of the spline between the honeycomb panel sheets in a tight-fitting relationship. The multicomponent panel system further includes a one-piece, solid, generally U-shaped trim member having a base intermediate of two parallel, spaced-apart sides, the sides being machined to enable insertion of the spline between the sides of the trim member in a tight-fitting relationship.

A preferred embodiment of the multicomponent panel system further includes a conduit chase member positionable between two adjacent honeycomb panels and defining a pathway for placement of wiring or the like.

In the preferred embodiment, the plate members are precisely pre-drilled as well as the edge portions of the panels so as to facilitate leveling of the plate members with the panels.

In the preferred embodiment, adhesive is placed on the male parts (inserters) and the female parts (receptors) are pre-drilled for receipt of screws used in attaching the components.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings wherein like reference numerals indicate corresponding parts throughout the several views:

FIG. 1 illustrates problems associated with prior art paneling structures which are not properly leveled;

FIG. 2 illustrates a multicomponent panel system in accordance with the principles of the present invention wherein honeycomb panels are being positioned on a bottom plate intermediate of two corner structures along one side of a building structure;

FIG. 3 illustrates a multicomponent panel system as shown in FIG. 2 with various ones of the components being illustrated separated from the other components;

FIG. 4 illustrates the formation of doorways and windows with a multicomponent panel system in accordance with the principles of the present invention;

DETAILED DESCRIPTION OF THE PREFERRED EMBODIMENT

Figure 5:
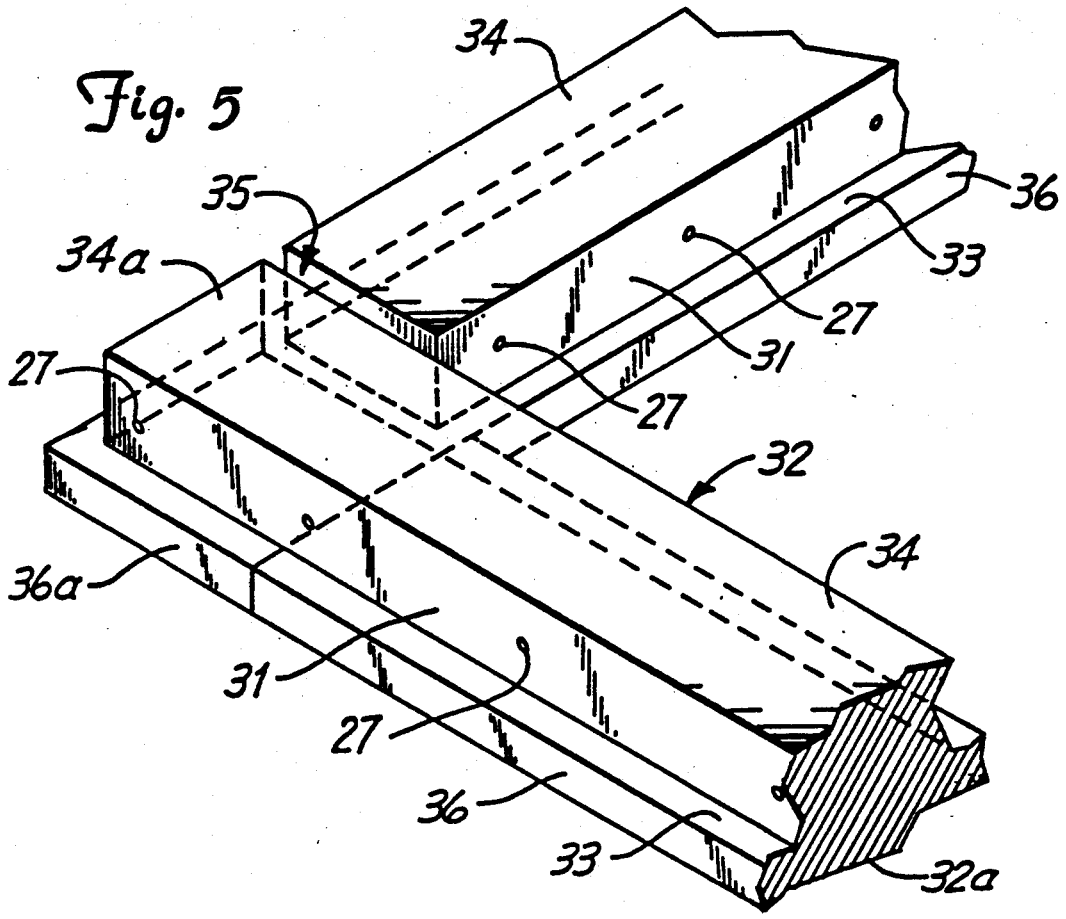
FIG. 5 illustrates the intersection of two bottom plates at a corner of the building structure, the plates configured to receive an embodiment of a corner plate structure in accordance with the principles of the present invention.

FIG. 1 illustrates a typical problem associated with prior art multicomponent panel system designs. FIG. 1 illustrates a prior art panel system 20 wherein the individual panels 22 are being positioned on a foundation 24 which is not perfectly level as is indicated by the level line 26. As is illustrated by this diagram, as subsequent panels are positioned this creates problems at the building site. Either the individual panels 22 will be inclined to follow the curvature or slope of the foundation or the building personnel will have to individually attempt to level each and every panel as it is positioned, which creates numerous problems. Similar problems are encountered when it comes to making sure the wall partitions are square. It is very difficult to assure that intersecting partitions will be square with one another because of the way they are attached to each other, the foundation not being square, etc.

FIG. 2 illustrates a panel system in accordance with the principles of the present invention, the panel system generally being referenced by the reference numeral 30. The components of the system are machined (planed) to very narrow tolerances. Referring now to FIGS. 2–8, the preferred embodiment of the multicomponent panel system 30 is illustrated as including a prefabricated, machined, one-piece, wooden plate 32, generally T-shaped in cross-section, which serves as a bottom plate 32*a* along the foundation and a top plate 32*b* proximate the ceiling. The plate 32 has a stepped-up portion 34 which is rectangular in cross-section and a base portion 36 of greater width than the stepped-up portion which is also rectangular in cross-section. In the preferred embodiment, the plate 32 is pre-drilled at precise locations 27 for receipt of a screw or the like.

A prefabricated honeycomb panel 40 is provided having two spaced-apart, parallel sheets 42 separated by a honeycomb structure 44 intermediate thereof. In the embodiment shown, the honeycomb structure 44 defines a plurality of openings roughly a half inch in diameter or so extending perpendicular of the sheets 42. The inside surfaces of the sheets 42 of the honeycomb panel 40 are machined along edge portions 41 about the periphery of the panel 40 to enable insertion of the stepped-up portion 34 of the plate intermediate of the sheets 42 in a tight-fitting relationship. In the embodiment shown, the inside surfaces along the edge portions 41 of the panels 40 are machined so as to provide roughly a two-inch, U-shaped receptor (cavity) 43. Accordingly, two of the panels 40 abutting at their side edge portions 41 will provide roughly a four-inch cavity. In particular, the walls and edges of the honeycomb sheets 42 and the plate 32 are closely machined such that the fit provided therebetween is a snug, tight fit which will retain the panel 40 on the plate 32 and yet enable the panel 40 to be slid into and out of position on the plate 32 by hand. In addition to the inside surface of the edge portions 41 being closely machined, the edges 39 of the panel 40 are also machined to assure a level and square interconnection of the panels 40 to one another and the plate 32. Preferably, the panels 40 are made of a wood material. It will be appreciated that the specific material and sizing of the sheets 42 as well as the specific honeycomb structure are immaterial to the invention. In the preferred embodiment, the panels 40 are pre-drilled at precise locations 45 to align with the pre-drilled holes in the plate thereby facilitating leveling of the system.

The multicomponent panel system 30 further includes a prefabricated, machined corner panel structure 50 comprising two honeycomb panels 40 secured to one another so as to form a ninety degree angle. A vertically extending support member 47 is positioned in the edge portion 41 of the panel 40*a* in an abutting relationship to the inner sheet 42 of the panel 40*b*. In the preferred embodiment shown in FIG. 5, one of the plates 32 interconnecting at the corner has a stepped-up portion 34*a* which extends over a base portion 36*a* of the other intersecting plate 32. A groove 35 is provided between the stepped-up portion 34*a* and the stepped-up portion 34 of the intersecting plate 32 so as to provide for insertion of a sheet 42 of the panel structure 40. The two intersecting plates 32 are preferably interconnected to one another by suitable adhesive and/or fasteners.

The multicomponent panel system further includes a prefabricated, machined spline 60 having sheets 62 and a honeycomb core 64 structured similar to the panel 40 but having machined outer surfaces so as to have a width such that the spline 60 snugly slides into place between opposing surfaces along the edge portion 41 of the panel structure 40. Accordingly, the spline 60 is used to interconnect two adjacent panels as is illustrated in FIG. 3. The width of the spline 60 might be such so as to fill the entire four-inch channel created by abutting edge portions 41 of the panels 40. In alternative embodiments, the spline might have a lesser width such as three inches so as to form a pathway for electrical wires or the like. Such a smaller spline is illustrated as 60*a* in FIG. 3, a pathway 59 being formed between the spline 60*a* and the panel honeycomb core 44. The spline 60 may be attached along the edge portion 41 of a panel 40 at the factory so as to provide a panel having a female receptor or recess along a first edge portion and a male receptor or projection along an opposite second edge portion. The splines 60 may also be separately shipped to the construction site. In the preferred embodiment, adhesive is applied to the spline 60 to facilitate attachment of the spline 60 to the panels 40.

The multicomponent panel system 30 further includes a one-piece, solid, generally U-shaped trim member 70 having a base portion 72 intermediate of two spaced-apart, parallel sides 74. The sides 74 of the trim member 70 are machined to tightly fit over the sides 62 of a spline member 60. The top of the base portion 72 provides a ledge 76 for resting of a header panel structure 78 thereon. The header 78 is similar to the panels 40. Such a header structure is used over doorways and windows. The header structure 78 in turn includes a support member 79 secured along a lower edge portion of the header 78 between the sheets 42 of the header panel 40 such as a 2×4, 2×6, etc. which rests on the ledge 76. In the preferred embodiment, the trim member is predrilled at locations 71.

A preferred embodiment of the present invention further includes a conduit chase member 80 machined to fit between the opposing facing sides 42 of a panel and defining a pathway for positioning of electrical wiring or the like therethrough. In one embodiment, the interior sheets 42 are cut along the edge portion 41 to provide an opening from the room into the pathway when the exterior sheets 42 are in abutting relationship behind the conduit chase member 80.

The components of the multicomponent panel system are prefabricated at the factory. The various components are closely machined such that interacting surfaces between the various ones of the components provide a very close, tight fit so as to enable the various components to be slid into place and yet provide a solid structure and retain their connection. In the preferred embodiment, male parts (inserters) are machined (planed) to within minus three thousandths of an inch (−0.003), i.e., the desired size to the desired size −0.0003 inches, whereas female parts (receptors) are machined to within plus three thousandths of an inch (+0.003), i.e., the desired size to the desired size +0.0003 inches. Most dimensions are machined to be within ± three to five thousandths of an inch. Additionally, this arrangement provides for a self-leveling and squaring system. Adhesive and/or threaded fasteners are preferably used to further interconnect various ones of the components. In particular, screws 82, such as drywall screws or self-tapping screws, are utilized to attach the panel structures 40 to the bottom and top plates 32*a,b* and for interconnecting the panels 40 to the splines 60. In addition to machining the major opposing facing surfaces of the components, the edges are also very closely machined to assure that they are level. Because of this, the prefabricated multicomponents can be readily assembled at the job site. Moreover, as they are assembled they will properly align and level themselves.

In the preferred embodiment, when first erecting a building structure 90, the bottom plate 32*a* is positioned about the foundation (see FIG. 4) with plates 32*a* intersecting in a corner as shown in FIG. 5. Typically, each side of a partition has only one plate. Anchor bolts 91 or the like are used to loosely fasten the plate 32 in place. Next, two corner panel structures 50*a*, 50*b* are positioned along a first side 92 of the building structure. The corner members 50*a,b* are tightly secured to the plate 32*a* such that a bottom edge 37 of the corner members 50*a,b* rests on a top surface 33 of the base portion 36. In addition, the sheets 42 are abutted against machined sides 31 of the stepped-up portion 34. This will square the corner. Panel structures are then placed between the two corner sections 50*a,b* onto the base plate 32*a*. The panel structures 40 are then securedly fastened into place by the use of the screws 82 or the like. As the panel structures 40 are fastened, they will pull the loosely mounted plate 32 into a parallel and aligned orientation. Shims 29 or the like are then used to support the plate 32 where any gaps occur between the plates 32 and the foundation 24. The anchor bolts 91 can then be tightened. Next, a third corner structure is placed opposite one of the first two corner structures 50*a,b*. Panel structures 40 are then positioned onto the base plate 32*a* and securedly fastened into place. It will be appreciated that by building the walls of the building structure 90 in this fashion, it will be assured that the walls are perfectly level and square relative to one another. In yet other approaches, only one corner structure need be positioned before positioning the panels 40.

Figure 7:
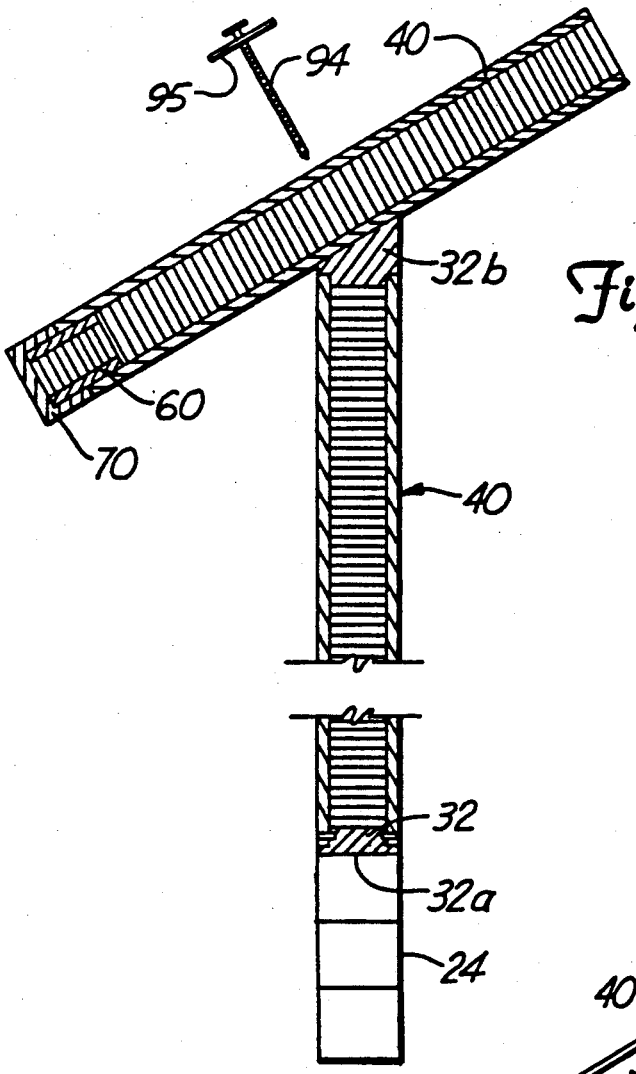
FIG. 7 is a sectional view illustrating attachment of a ceiling panel structure to a wall panel structure in accordance with the principles of the present invention.
Figure 8:
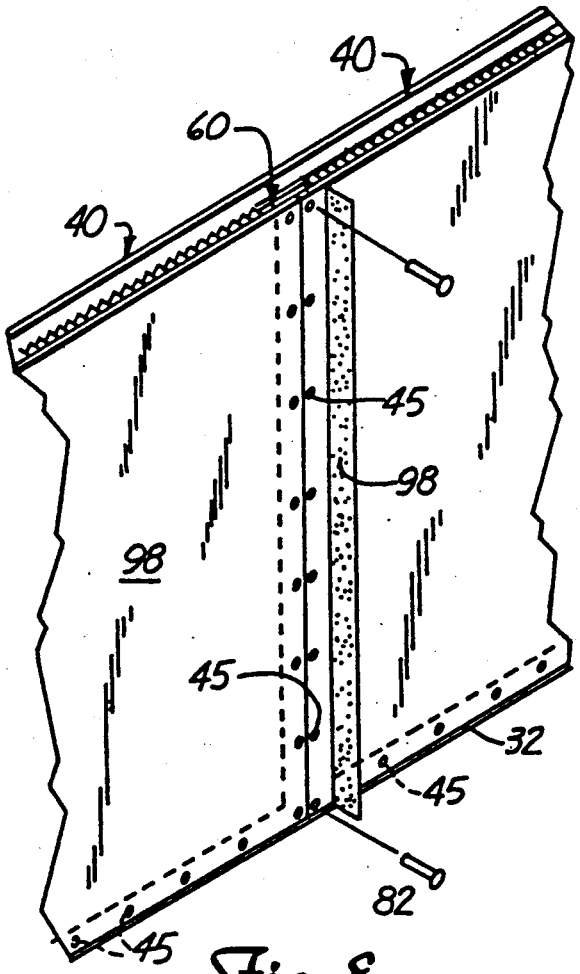
FIG. 8 is a view illustrating panel structures having a covering material thereon.

Illustrated in FIG. 7 is an embodiment of a top plate structure 32*b* which is inclined so as to provide the desired incline or slope for a ceiling panel which is also formed by one of the panel structures 40. The panel structure 40 is suitably secured to the top plate 32*b* by a threaded, elongated member 94 having an enlarged washer or plate 95 suitably mounted thereon so as to prevent any damage to the sheet 42 of the panel 40. A spline 60 and a trim member 70 are used to form an overhang.

Figure 6:
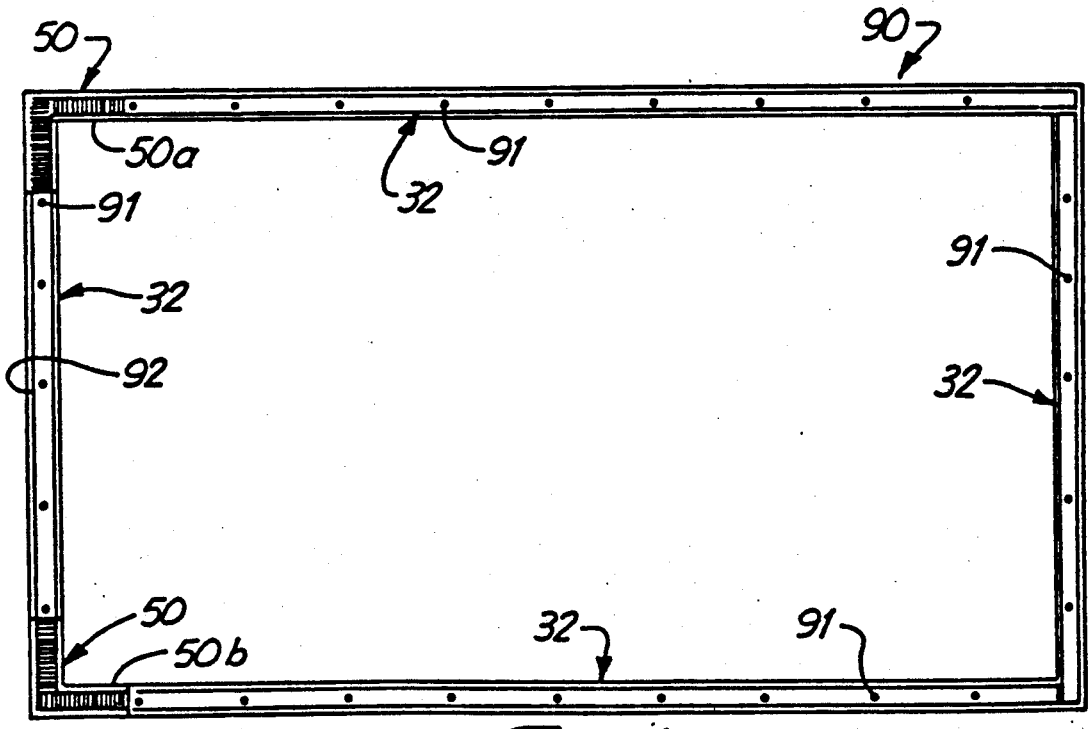
FIG. 6 illustrates positioning of two corner panel structures along a first side of a building structure.

As illustrated in FIGS. 5 and 6, doorways and windows 96 are formed by cooperation of the spline 60 and the trim member 70 so as to provide the ledge 76 for supporting the support member 79 of a doorway or window header 78. As shown in FIG. 6, the bottom frame of the window is formed by the cooperating spline member 60 and the trim member 70.

In some embodiments, the panels 40 might have a material covering 98, e.g., wallpaper, applied at the factory. The covering 98 preferably will have a release layer along its edges so that the edges of the covering 98 can be pulled back to allow the panels to be threadedly fastened via pre-drilled holes 45 to the splines 60, plates 32, etc. and then attached along the edges to the panels 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A prefabricated multicomponent panel system, comprising:

(a) a machined, one-piece plate having a generally T-shaped cross-section and including a stepped-up portion rectangular in cross-section and a base portion rectangular in cross-section, the base portion being of greater width than the stepped-up portion;

(b) a honeycomb panel structure having two spaced-apart, parallel sheets separated by a honeycomb structure intermediate thereof, the honeycomb structure defining a plurality of openings extending perpendicularly of the sheets, inside surfaces of the sheets of the honeycomb panel being machined along edge portions of the panel, the stepped-up portion of the plate being insertable intermediate of the sheets in a tight-fitting relationship;

(c) a machined panel corner structure comprising two honeycomb panels interconnected to form a ninety degree angle;

(d) a spline member being rectangular in cross-section and comprising two spaced-apart parallel sheets separated by a honeycomb structure, the outside surfaces of the spline member being machined to enable insertion of the spline member between the sheets of the honeycomb panel in a tight-fitting relationship; and (e) a one-piece, solid, generally U-shaped trim member having a base intermediate of two parallel, spaced-apart sides, inner surfaces of the sides being machined to enable insertion of the spline between the sides of the trim member in a tight-fitting relationship.

2. A system in accordance with claim 1, further including a conduit chase member positionable between two adjacent honeycomb panels and defining a pathway for placement of wiring or the like.

* * * * *